US005951075A

United States Patent [19]

Green

[11] Patent Number: 5,951,075

[45] Date of Patent: Sep. 14, 1999

[54] APPARATUS FOR PICKING UP, TRANSPORTING, AND STORING BALLS

[75] Inventor: Peter F. Green, New Orleans, La.

[73] Assignee: Proball, Inc., New Orleans, La.

[21] Appl. No.: 08/923,367

[22] Filed: Sep. 3, 1997

Related U.S. Application Data

[60] Provisional application No. 60/025,371, Sep. 3, 1996, and provisional application No. 60/032,880, Dec. 13, 1996.

[51] Int. Cl.[6] ..... A63D 47/02

[52] U.S. Cl. ..... 294/19.2; 206/315.9; 224/919

[58] Field of Search ..... 294/19.2, 99.1; 206/315.1, 315.9; 224/258, 607, 919

[56] References Cited

U.S. PATENT DOCUMENTS

| | | | |
|---|---|---|---|
| D. 88,081 | 10/1932 | Glock . | |
| 438,150 | 10/1890 | Glover . | |
| 463,507 | 11/1891 | Goodell et al. . | |
| 2,832,188 | 4/1958 | Harrell et al. | 294/19.2 |
| 2,960,263 | 11/1960 | Goddard . | |
| 3,014,595 | 12/1961 | Bartmann . | |
| 3,412,897 | 11/1968 | Slater . | |
| 3,756,299 | 9/1973 | Simmons et al. | 294/19.2 |
| 3,980,215 | 9/1976 | Schwarzbauer | 224/919 |
| 4,013,295 | 3/1977 | Baughman | 294/19.2 |
| 4,184,707 | 1/1980 | Nelson et al. . | |
| 4,193,625 | 3/1980 | Nelson . | |
| 4,214,684 | 7/1980 | Galowitz | 224/919 |
| 4,278,119 | 7/1981 | Elmore . | |
| 4,334,601 | 6/1982 | Davis . | |
| 4,596,413 | 6/1986 | LaPorte . | |
| 4,716,796 | 1/1988 | Corona et al. . | |
| 4,797,040 | 1/1989 | Hibbard . | |
| 4,993,548 | 2/1991 | Peterson | 224/919 |
| 5,083,797 | 1/1992 | Vartija et al. . | |
| 5,086,948 | 2/1992 | Slusarz . | |
| 5,238,162 | 8/1993 | LaCivita . | |
| 5,292,161 | 3/1994 | Green . | |
| 5,427,003 | 6/1995 | Boltak et al. . | |
| 5,433,491 | 7/1995 | Green . | |
| 5,634,680 | 6/1997 | Green . | |

FOREIGN PATENT DOCUMENTS

| | | | |
|---|---|---|---|
| 289428 | 4/1988 | European Pat. Off. . | |
| 1380203 | 10/1964 | France | 294/19.2 |
| 412707 | 7/1934 | United Kingdom | 294/19.2 |
| 2271937 | 5/1994 | United Kingdom | 294/19.2 |

*Primary Examiner*—Dean Kramer
*Attorney, Agent, or Firm*—Garvey, Smith, Nehrbass & Doody, L.L.C.

[57] ABSTRACT

Apparatus for picking up, transporting and storing balls comprises two oposing planes separated by tension elementss which when forced over a solid, hollow or pressurized sphere simultaneously stretches the tension elements and/or compresses the sphere sufficiently to permit the sphere entry between the planes. Once the sphere is between the planes it is kept in place by the forces created by the stretched tension trying to regain their original unstretched configuration and the pinched sphere trying to regain its original configuration by trying to expand out.

10 Claims, 9 Drawing Sheets

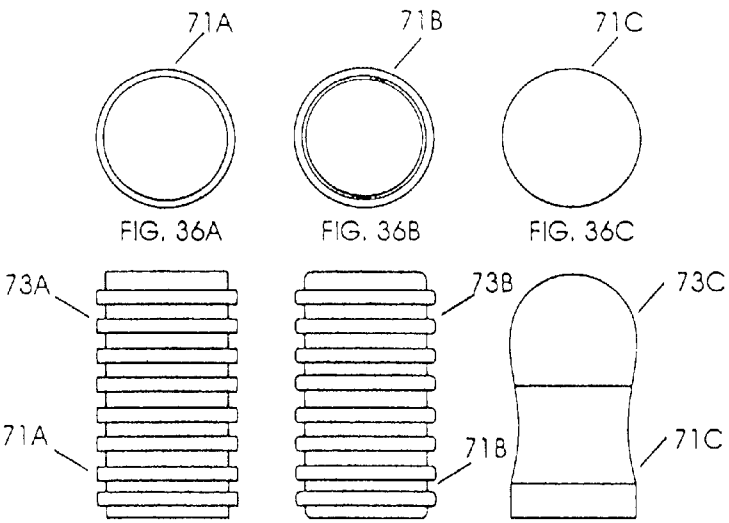
71A
FIG. 36A
71B
FIG. 36B
71C
FIG. 36C
73A
FIG. 36D
73B
FIG. 36E
73C
FIG. 36F
71A
71B
71C
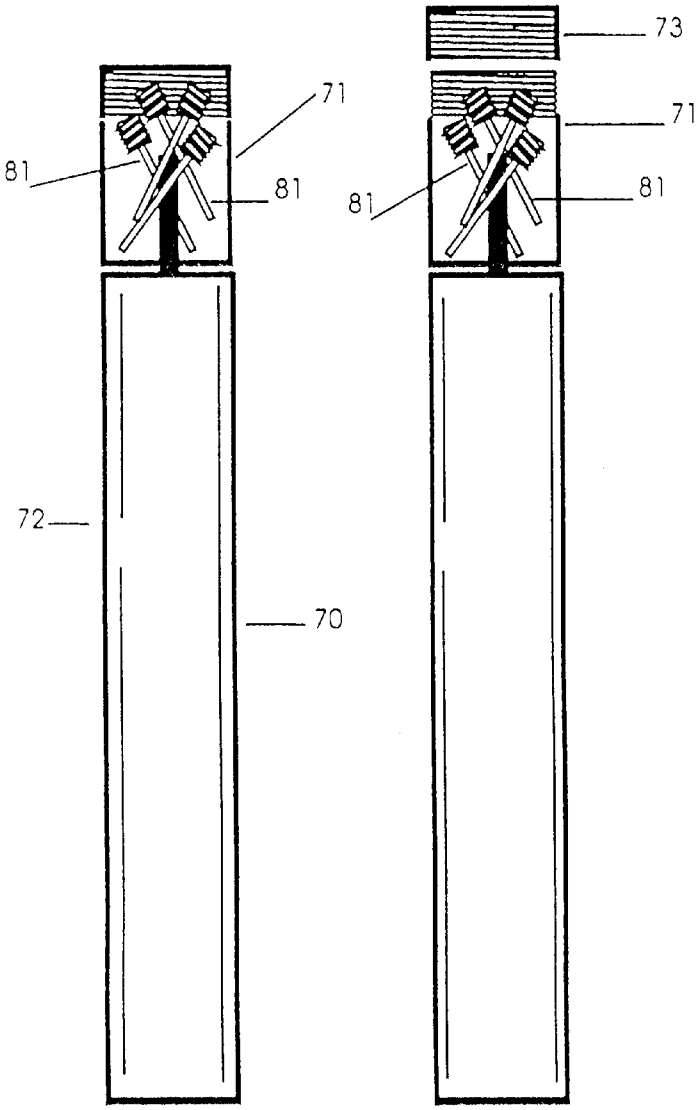
73
71
81
81
FIG. 35
71
81
81
70
72
FIG. 34

APPARATUS FOR PICKING UP, TRANSPORTING, AND STORING BALLS

CROSS-REFERENCE TO RELATED APPLICATIONS

Priority of U.S. Provisional patent application Ser. No. 60/025,371, filed Sep. 3, 1996, for "Ball Pump Including Spare Needles and Storage for Spare Needles" and of U.S. Provisional patent application Ser. No. 60/032,880, filed Dec. 13, 1996, for "Apparatus for Picking up, Transporting, and Storing Balls", both incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to apparatus for use with sports balls. More particularly, the present invention relates to sports ball retrieving, transporting, and storing apparatus.

2. General Background of the Invention

The most common means of transporting and storing larger sports balls is in a bag made of mesh netting whose opening and closing is controlled by a draw string. Loosening the draw string permits the bag to be opened sufficiently to allow the balls to be placed in the bag. The draw string is then drawn or pulled to sufficiently reduce the bag opening and then fastened to prevent the balls from falling or rolling out of the net bag. Another common means of transporting and storing balls is a bag made of canvas, mesh or various synthetic fabrics (i.e. nylon) or a combination of these materials whose opening is controlled by the use of fasteners (including but not limited to zipper(s), Velcro brand fastening strips, snaps, hooks, buttons, rope, bungee cords or other devices or means). The fastener is unfastened and the balls are placed in the bag. The fastener is then refastened which helps prevent the balls from falling or rolling out of the bag.

The above-mentioned netting and bag represent the state of the art for larger balls (i.e. soccer, volleyball, basketball, football, rugby, general recreational balls used in grade schools, etc.) and are only capable of transporting and storing balls not picking up the balls. The bags and nets when used for storage present additional problems. It is difficult, and at time impossible, to do an accurate visual inventory of the balls because of the opacity of the fabric or the inability to clearly see all the balls in a net because some balls will partially or totally block the view of the other balls. Since a quick, accurate, visual inventory cannot be done with bags or nets, balls will be lost. The loss of balls is a costly event because of the constant need of buying unnecessary replacements.

Storing balls in bags is undesirable because many types of balls need to dry out thoroughly and bags do not permit air to circulate easily around the ball which increases the likelihood of mold and mildew which reduces the life of the ball. Nets and bags are awkward to hang for storage and normally end up of the floor. For example, in youth soccer leagues, each team has a ball bag and at the end of the season there may be fifty or more bags left on the floor as storage. This is not only a very poor way to store balls but it is a time consuming nightmare for the equipment managers who do the yearly inventory for leagues with many teams.

The nets and bags are not capable of picking up the balls, awkward to open, difficult to load (really a two person operation) and virtually impossible to get a quick accurate visual inventory which increases the chance of losing balls. One professional soccer team mentioned that they lose two soccer balls per practice. Recreational youth leagues give out fewer and fewer balls to the volunteer coaches because so many balls are lost or not returned at the end of the season. It is estimated that leagues replace between 15–25% of their ball inventory every season simply due to loss.

It can clearly be seen that there exists a need for an apparatus for picking up, transporting and storing balls for convenience, practicality and monies saved by having to purchase fewer replacement balls.

The following references are incorporated herein by reference (as are all references cited by these references): (related to the ball retriever):

U.S. Pat. Nos. 4,184,707; 4,193,625; 4,334,601; 4,596,413; 5,083,797; 5,086,948; 5,238,162; 5,292,161; 5,433,491; 5,634,680; EP 289 428 A; (related to the ball pump):

U.S. Pat. Nos. 438,150; 463,507; Des. 88,081; 2,960,263; 3,014,595; 3,412,897; 4,278,119; 4,716,796; 4,797,040; 5,427,003.

BRIEF SUMMARY OF THE INVENTION

The present invention comprises two independent, rigid or semi rigid, rectangular frames held parallel by equal (or approximately equal) lengths of tension elements (elastic cords) at /or near (within 12 inches) of each corner of the frame. If the frame is lengthened or widened (two or more ball apparatus frames are aligned and attached together either permanently or temporarily) additional tension elements may be placed along the frame to insure that sufficient tension is maintained to hold (pinch) the balls between the framing members.

The force necessary to stretch the tension elements is important. It is essential that the tension element provide sufficient tension to hold the balls in the frame yet be capable of being stretched to allow the ball to enter the frame with moderate effort. The size, type and number of balls to be picked up and transported determines the relative tension range necessary (i.e. the collective tension necessary to pick up and store 12 ping pong balls is very little, less than 5 ounces, whereas the collective tension necessary in a single ball apparatus to pick up and store four size 4 soccer balls is between 10 to 24 lbs. of tension (force)).

The width of the frame is determined by the diameter of the ball (volume) to be picked, transported or stored. The interior width of the framing members must be narrow enough to prevent the ball (volume) from falling through or getting stuck in the frame yet wide enough to create a channel to help hold the balls securely in the apparatus. If one were to inscribe a square in a circle, where the four comers just touch the circle, the width of the square is equal to approximately 70% of the diameter of the circle. Therefore, the corners of the inscribed square are the optimum stable points to apply pressure. The optimum design is to have the framing members pinch the balls at the stable points and then provide adequate channel width to help insure that the balls stay in the apparatus. The range for an open framing member (channels to the hold balls) is 50–90% of the ball diameter.

The present invention comprises a ball retrieving apparatus for retrieving balls of a first diameter, comprising a pair of parallel, spaced-apart frames and tensioning means connecting the two frames, urging the frames together, the tensioning means applying sufficient tension on the frames to normally keep them apart a distance less than the first diameter, but the tensioning means being sufficiently elastic to allow the frames to separate enough to allow a ball to pass between the lower portion of the frames. Preferably, the tensioning means also comprise spacing means for urging the frames apart.

The present invention can also be described as apparatus for picking up, transporting and storing balls, comprising:

two opposing frames;

tension elements separating the two opposing frames;

wherein, when the two opposing frames are forced over a sphere, the tension elements stretch and/or the sphere compresses sufficiently to permit the sphere to enter between the frames, and once the sphere is between the frames it is kept in place by the forces created by the stretched tension elements trying to regain their original unstretched configuration and the pinched sphere trying to regain its original configuration by trying to expand out. The tensioning means preferably also comprise spacing means for urging the frames apart. The frames can advantageously have a width less than the diameter of a ball to be retrieved therewith, and the frames are preferably spaced apart less than the diameter of a ball to be retrieved therewith. In some cases, the frames have a width less than twice the diameter of a ball to be retrieved therewith. Preferably, the frames have a length aprroximately equal to four to five times the diameter of a ball to be retrieved therewith.

The ball retrieval apparatus of the present invention can be used for balls for soccer, volleyball, basketball, football, rugby, general recreational balls used in grade schools, baseballs, tennis balls, ping pong balls, and golf balls, for example (in general, when used for smaller balls, the number of balls held per retriever increases).

The present invention also includes ball pump apparatus comprising a ball pump which uses detachable needles for inflating balls and at least one storage receptacle for the detachable needles. Preferably, the ball pump includes a handle having an outer diameter and a barrel having an outer diameter, there is a storage receptacle in the handle, and the outer diameter of the handle is approximately equal to the outer diameter of the barrel. The storage receptacle could instead or in addition be in the barrel. The handle is preferably at least partially transparent. Preferably, a plurality of needles are included in the receptacle. Preferably, the needles are positionable in the receptacle to make noise when the ball pump is shaken; for example, the needles can be stored loose in the storage receptacle in the handle.

BRIEF DESCRIPTION OF THE DRAWINGS

For a further understanding of the nature, objects and advantages of the present invention, references should be had to the following detailed description taken in conjunction with the accompanying drawings, in which like reference numerals denote like elements, and wherein:

FIGS. 34–47 show the ball pumps of the present invention

DETAILED DESCRIPTION OF THE INVENTION

Ball Retrieving apparatus

Figure 1:
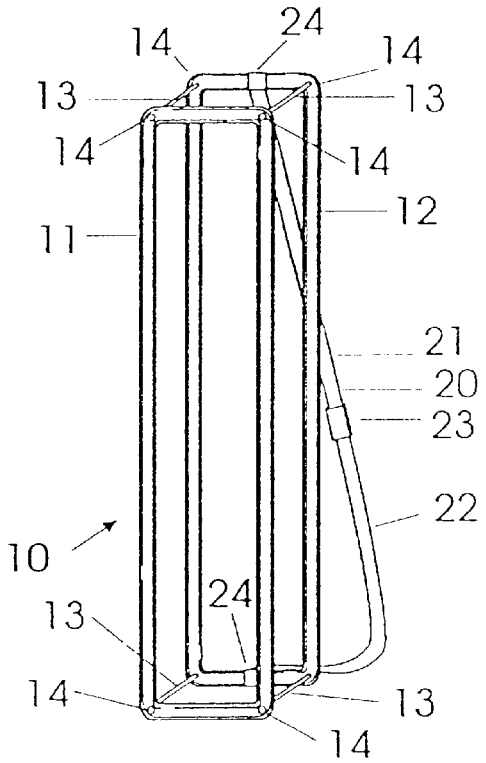
FIGS. 1–33 show the ball retrievers of the present invention.
Figure 2:
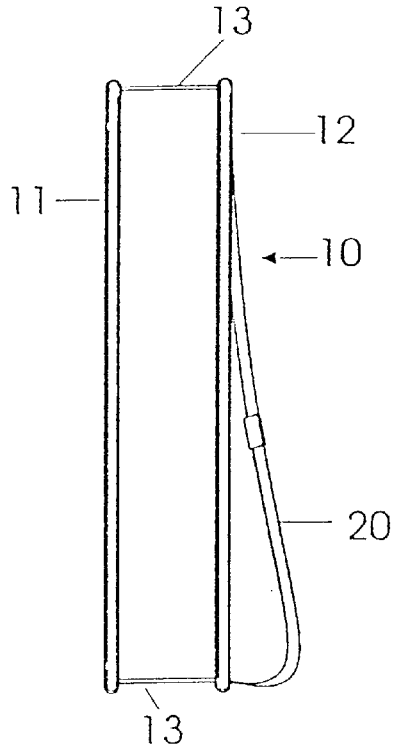
Figure 6:
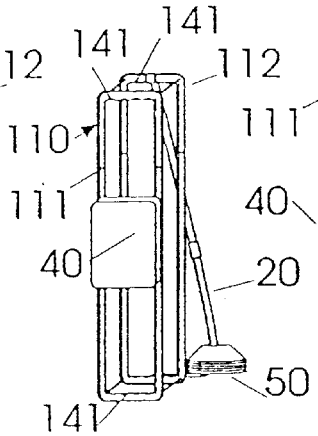
Figure 7:
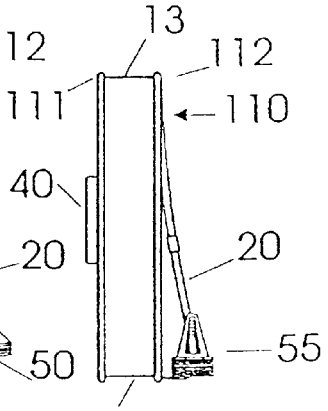

FIGS. 1 and 2 show a first embodiment of the ball retrieving, storing, and transporting apparatus of the present invention, ball retriever 10. Ball retriever 10 includes two frames 11, 12 made of preferably tubular material, such as aluminum or plastic pipe (such as polyvinylchloride—PVC). Bungee cords 13 (or other suitable tensioning means or tension elements) connect frame 11 to frame 12, passing through holes drilled or otherwise formed in frames 11 and 12. Caps 14 could be threaded and include a slot for a screwdriver (or could simply be plugs which friction fit into the outside holes) to close the outer holes through which bungee cords 13 pass (the outer holes are bigger than the inner holes to allow a knot or crimp or other bungee cord retaining means to pass into frames 11 and 12). A strap 20 includes a first portion 21 and a second portion 22 connected with a buckle 23 to allow strap 20 to come apart for loading of cones 50, 55 (as shown in FIGS. 6 and 7). Strap 20 is held onto the frame 12 with sewn loops 24. Retriever 10 can preferably hold 4 balls (such as size 4 or size 5 soccer balls, volley balls, footballs, basketballs, etc.).

One could omit the sewn loops 24 and buckle 23 from strap 20 and instead use attaching devices such as Velcro brand hook-and-loop fasteners or snaps on each end of the strap 20 to hold strap 20 onto frame 12 and allow the strap 20 to receive cones 50, 55. End attachments are ultimately more convenient to use but increase production costs.

Figure 3:
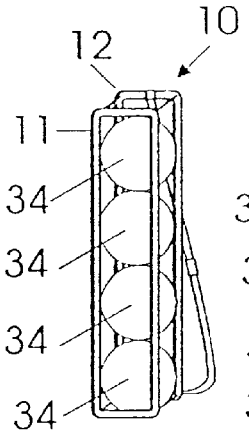
Figure 4:
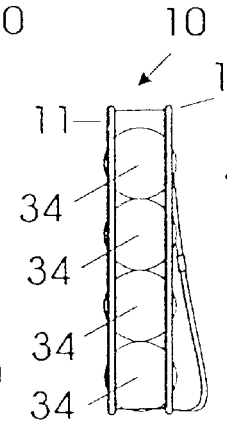
Figure 5:
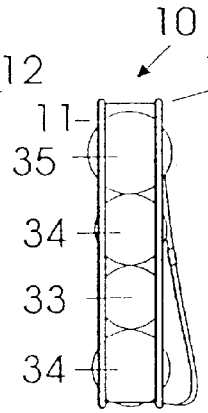

FIGS. 3, 4, and 5 show soccer balls in apparatus 10. In FIGS. 3 and 4, there are four size 4 balls 34. In FIG. 5, there are two size 4 balls 34, one size 5 ball 35, and one size 3 ball 33.

FIGS. 6 and 7 show an alternative ball retriever 110 which includes telescoping frames 111 and 112 (to allow the number of size 4 balls to be carried to vary from 3 to 5, for example). Any suitable telescoping means can be used to accomplish this. Also, frames 111 and 112 include textured handles 141 to allow easy grasping of the retriever 110. Retriever 110 also includes a bag 40 (zippered, for example) for holding a first aid kit, for example.

Figure 8:
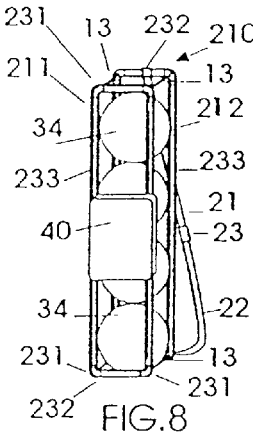
Figure 13:
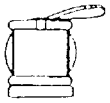
Figure 14:
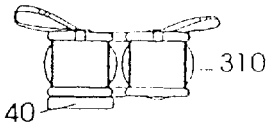

FIGS. 8 and 13 show the preferred embodiment of the present invention, retriever 210. Retriever 210 includes first, second, third, fourth, fifth, sixth, seventh and eighth 1¾" by 1¾" PVC elbow connectors 231 for connecting ¾" PVC pipe, each elbow connector having a ¼" diameter hole drilled therein. Retriever 210 also includes a first ¼" diameter, 5½" long, bungee cord 13 connecting the first and fifth elbow connectors, a second ¼" diameter, 5½" long, bungee cord 13 connecting the second and sixth elbow connectors, a third ¼" diameter, 5½" long, bungee cord 13 connecting the third and seventh elbow connectors, a fourth ¼" diameter, 5½" long, bungee cord 13 connecting the fourth and eighth elbow connectors. A first 4" long PVC pipe 232 is connected to the first and second elbow connectors with internal pipe connectors, a second 4" long PVC pipe 232 is connected to the third and fourth elbow connectors with internal pipe connectors, a third 4" long PVC pipe 232 is connected to the fifth and sixth elbow connectors with internal pipe connectors, and a fourth 4" long PVC pipe 232 is connected to the seventh and eighth elbow connectors with internal pipe connectors. A first 32½" long PVC pipe 233 is connected to the first and third elbow connectors with internal pipe connectors, a second 32½" long PVC pipe 233 is connected to the second and fourth elbow connectors with internal pipe connectors, a third 32½" long PVC pipe 233 is connected to the fifth and seventh elbow connectors with internal pipe connectors, and a fourth 32½" long PVC pipe 233 is connected to the sixth and eighth elbow connectors with internal pipe connectors. Strap 20 having a first 2' long part 21 and a second 2' long part 22 is connected to the first and second 4" long PVC pipes, the strap 20 having a disconnectible connector 23 to allow the first part of the strap to be separated from the second part of the strap. A bag 40 is riveted to the third and fourth 32½" long PVC pipes 233; bag 40 may have a zippered opening (with two zippers, for example).

Figure 9:
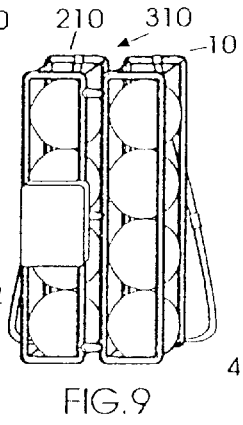

FIG. 9 shows retriever 310, which could, for example, comprise retriever 10 connected to retriever 210 as, for example, with glued connectors.

Figure 10:
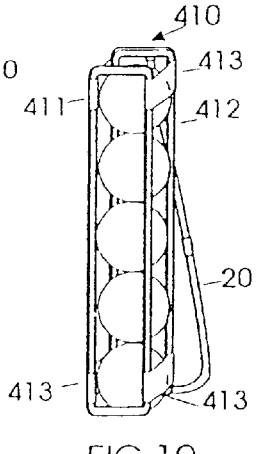
Figure 11:
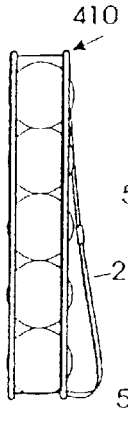

FIG. 10 shows a retriever 410 long enough to hold 5 size 4 soccer balls. Instead of bungee cords 13, retriever 410 uses elastic fabric panels 413, made of for example Spandex brand elastic fabric, as the tensioning means. Panels 413 include suitable means to hold them onto frames 411, 412 (such as sewn loops). The frames 411 and 412 can be made of the materials of any of the other frames.

Figure 12:
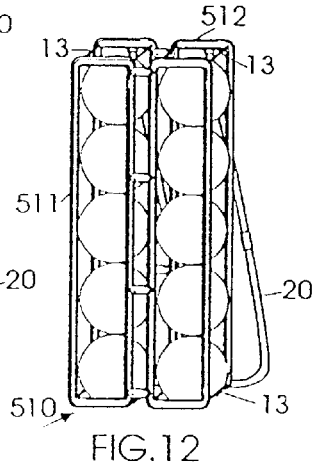

FIG. 12 shows a double retriever 510 including two straps 20, with wide frames 511 and 512.

Figure 15:
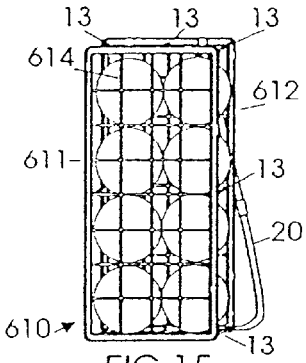
Figure 16:
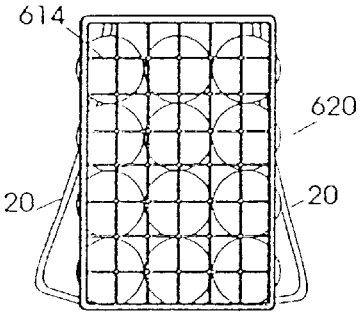
Figure 17:
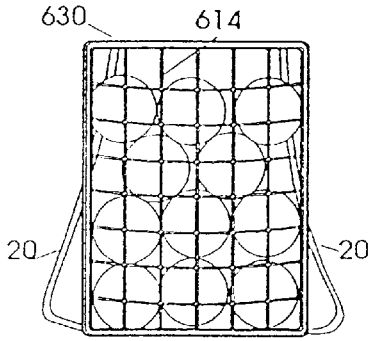
Figure 18:
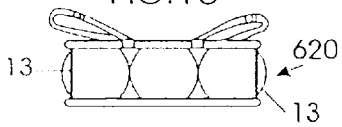
Figure 19:
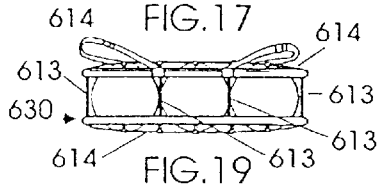
Figure 20:
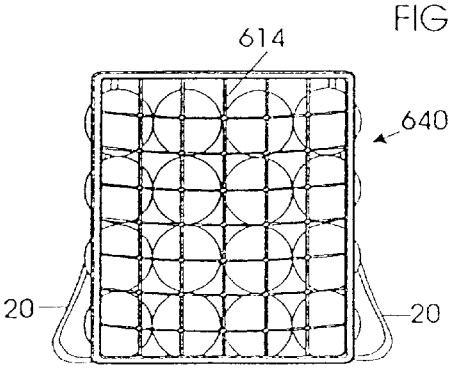
Figure 21:
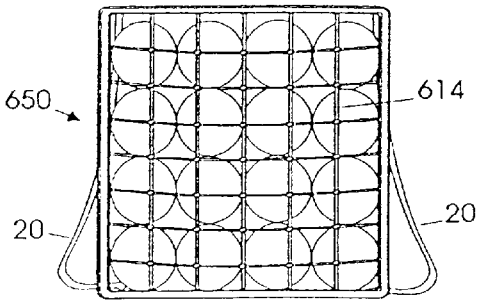
Figure 22:
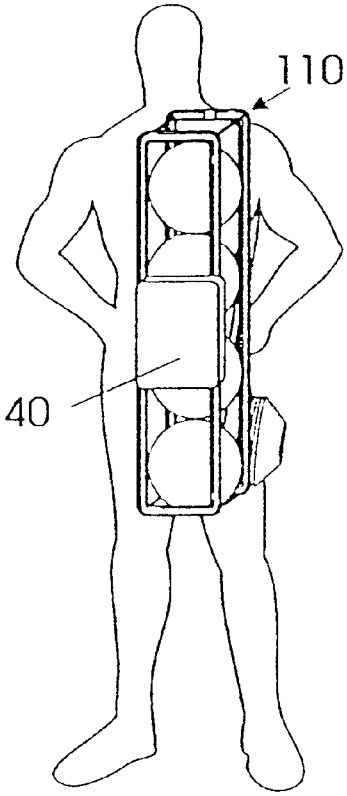
Figure 23:
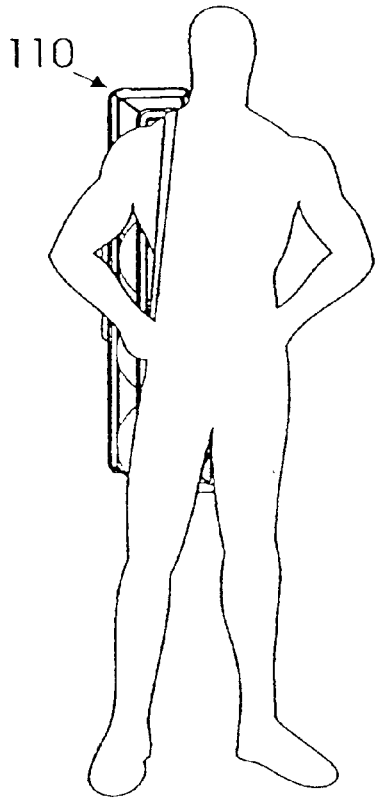
Figure 24:
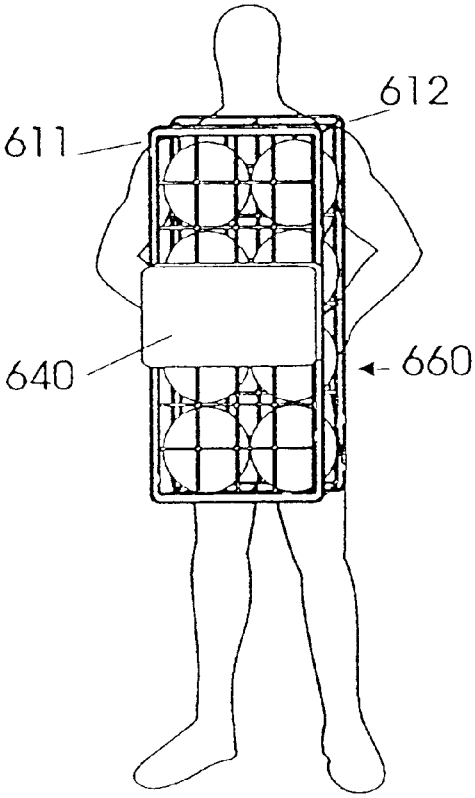
Figure 25:
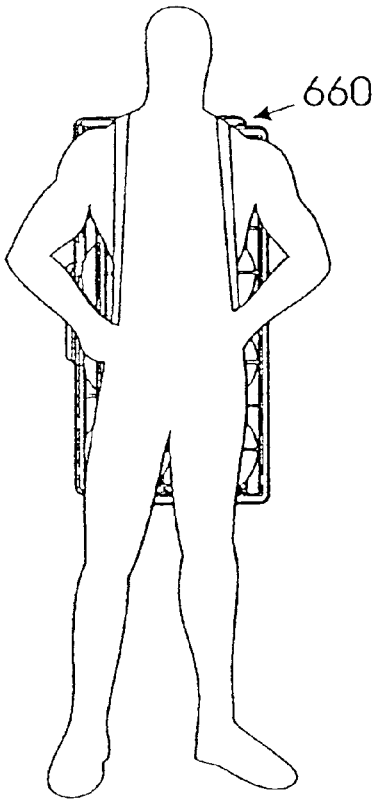

FIGS. 15–21, 24, and 25 show retrievers of the present invention including netted frames to allow the retrievers to hold more than one vertical line of balls. Retriever 610 is shown in FIG. 15 and includes netted frames 611 and 612. The net material 614 can be attached to frames 611 and 612 in any suitable manner. Retriever 620 is shown in FIGS. 16 and 18 and is slightly narrower than three size 4 soccer balls, while retriever 630 shown in FIGS. 17 and 19 is slightly wider than three size 4 soccer balls. Retriever 640 is shown in FIG. 20 and is slightly narrower than four size 4 soccer balls, while retriever 650 shown in FIG. 21 is slightly wider than four size 4 soccer balls. Retriever 660, shown in FIGS. 24 and 25, includes a wide bag 640. An advantage of the netted retrievers is that they weigh less per ball capacity than the non-netted retrievers shown in FIGS. 1–14 (when the frames are made of the same material).

Figure 26:
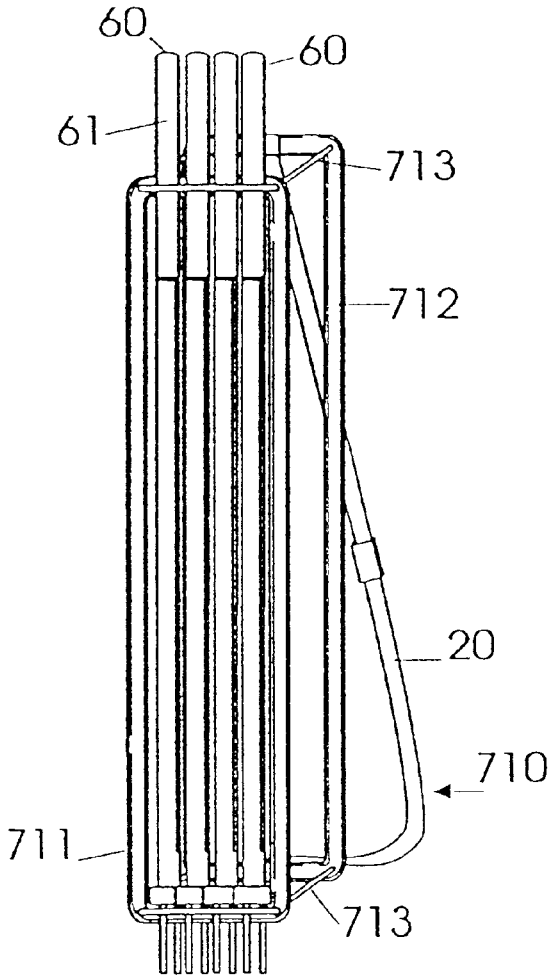
Figure 27:
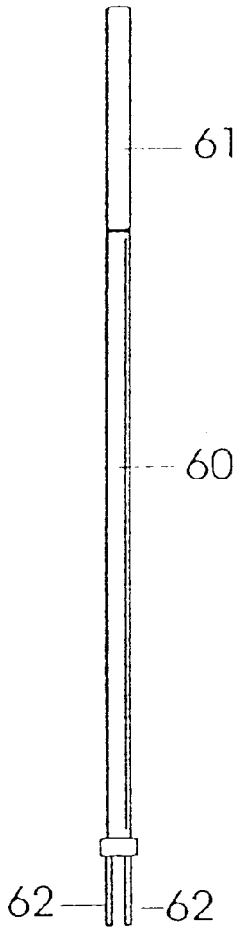
Figure 28:
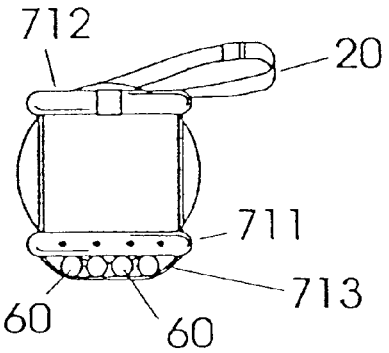
Figure 29:
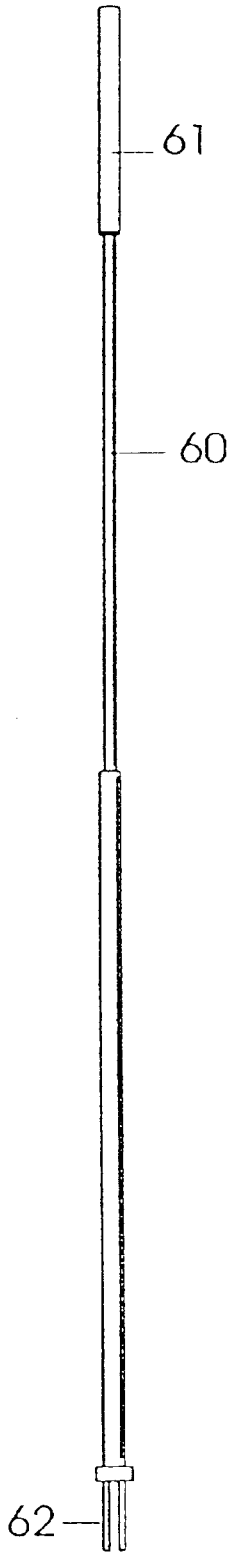

FIGS. 26 and 28 show a retriever 710 which includes a single piece 713 of bungee cord at the top and a single piece 713 at the bottom which provide elastic members to hold a number of flag poles 60. Suitable means can be provided to prevent lack of flag poles 60 in the retriever 710 from affecting the tension between frames 711 and 712. Flag poles 60 are preferably telescoping, as shown in FIG. 29, from about three or three and a half feet in length to a regulation height for soccer games. Highly visible flags 61 could be made of any high-visibility material and could be replaced with standard orange plastic flags. Flag poles 60 could be made of white PVC pipe, for example. Flag poles 60 have suitable means, such as spikes 62, for holding poles 60 in the ground.

It may be desirable, when plastic pipe is used to make the frames (such as frames 11, 12, 112, 113, 211, 212, 611, 612) to put vent holes somewhere in the frame to allow heat to escape from the pipe to perhaps prevent the pipe from warping when left in a hot car.

As can be seen in the drawings, it is preferred to have only one vertical layer of balls in the ball retrieving apparatus of the present invention to allow the balls to be easily counted.

FIGS. 30–33 show a bag 150, which is similar to a standard, commercially available net bag for soccer balls, but which has an easy means for opening and closing the bag. The net portion 151 of bag 150 could be made of nylon, for example. Bag 150 includes a net portion 151 and a closure portion 152. The closure portion 152 can include a plastic loop 153 and some means for closing the portion of the loop 153 adjacent the opening of the bag 150. The loop 153 can be slidably threaded onto the net portion 151 of the bag, and a closure slide 154 can be somehow fixedly attached to a portion of the net portion 151 of the bag 150 so that sliding the closure slide 154 toward the bag opening causes the opening to close, and sliding the closure slide in the other direction causes the opening to open. Loop 153 is sufficiently stiff to cause the net portion of the bag to open when the slide is moved away from the opening.

Figure 32:
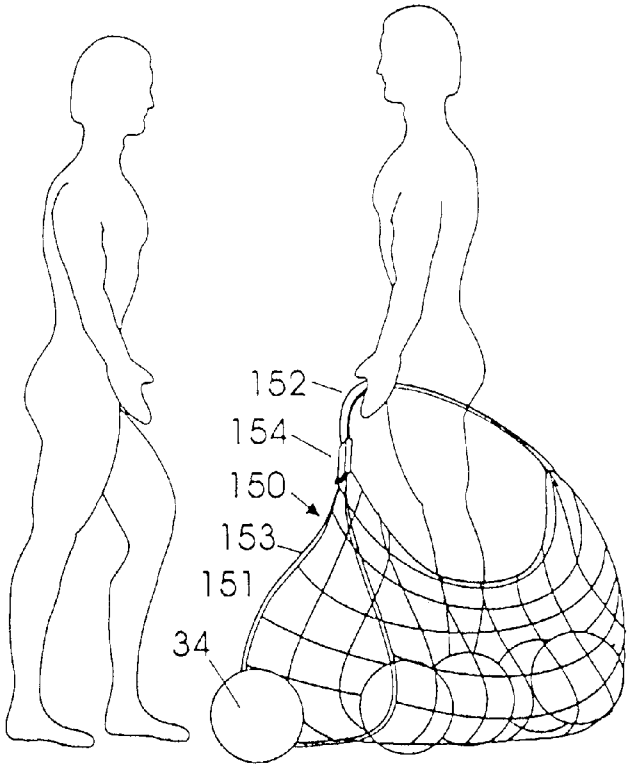
Figure 31:
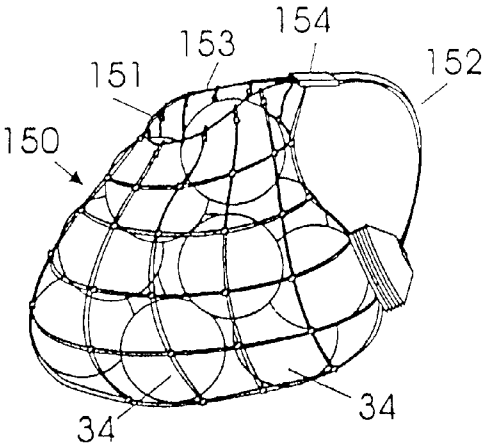
Figure 30:
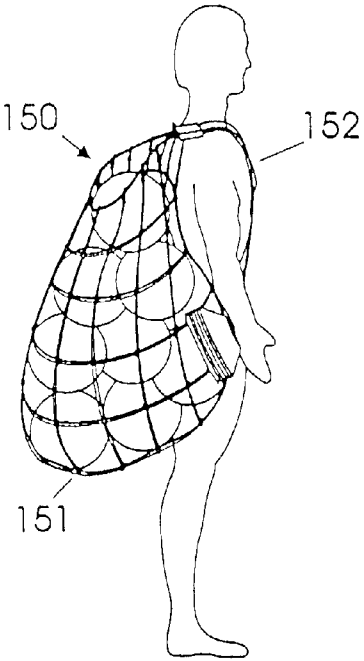
Figure 33:
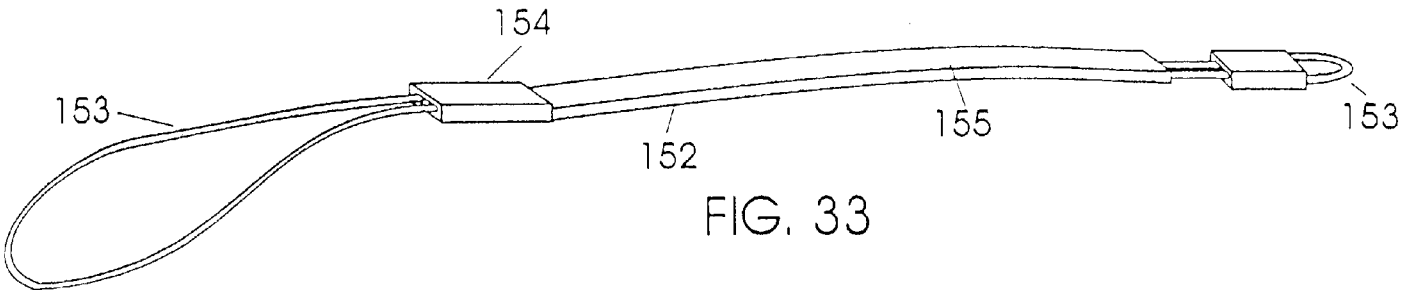

Loop 153 can be made of a thin flexible plastic hollow tube material (or it could be solid) so that when it opens, it flexes the net open and allows balls to be easily pushed in with one's feet, as shown in FIG. 32. A strap portion 155 is preferably made of some comfortable material to allow the bag 150 to be easily comfortably carried on one's shoulders.

The net portion 151 of bag 150 could be made of nylon, for example.

The loop 153 can, at its end distal from the opening of the bag, removably connect to the net so that cones 50, for example, can be carried on the loop 153. Sports pump apparatus:

The sports pump of the present invention could be attached in some suitable manner to the ball retrieving apparatus of the present invention.

FIGS. 34–47 show sports pumps of the present invention with capability of holding spare needles (and preferably including spare needles therein).

The pump of the present invention can comprise a standard ball pump modified as described herein. In the preferred sport pump 70 of the present invention (see FIGS. 34 and 35), the handle 71 has a diameter approximately equal to the diameter of the barrel 72 or compression cylinder 72 of the sport pump, and has a length great enough to allow spare needles 81 to easily be placed therein. Preferably, the needles 81 can be loose in the handle 71 (as shown in FIG. 34) so that they will rattle around to give an audio signal to the pump owner that there are still spare needles available. The top 73 of the handle is preferably removable (it can be hinged, threaded, friction fit, or magnetic fit). The hollow handle 71 is preferably clear to allow a visual indication of the presence of spare needles 81 (though it could be opaque).

The base of the cap may be optionally threaded to screw onto the compression cylinder (it may also be latched or friction fit).

The lower end of the compression cylinder has a threaded inset for the needle to screw in to.

FIGS. 36A–36F show alternative designs for the hollow handle (handles 71A, 71B, 71C, with removable, for example screw-on, caps 73A, 73B, 73C).

Figure 37:
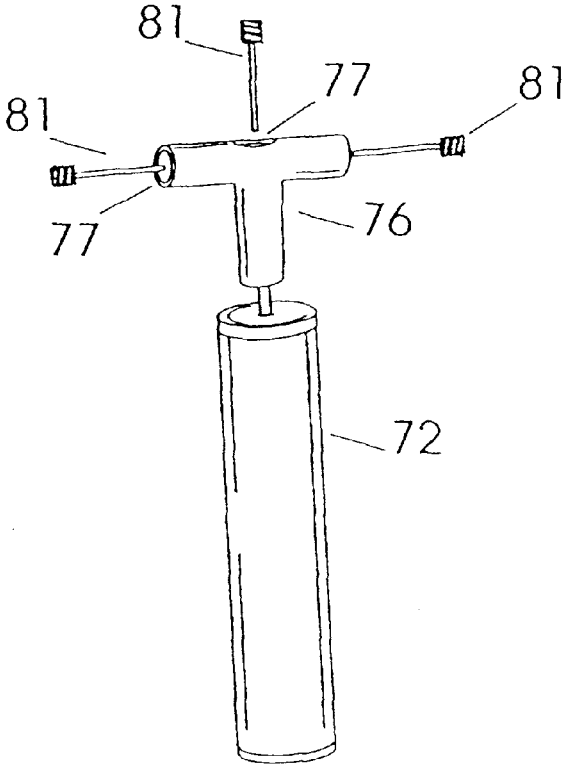

The hollow handle may instead by T-shaped (as handle 76 shown in FIG. 37). Spare needles 81 can be stored as indicated in FIG. 37, and the ends of the storage spaces 77 can be plugged with magnets or any other means for preventing the needles 81 from falling out and being lost.

Figure 38:
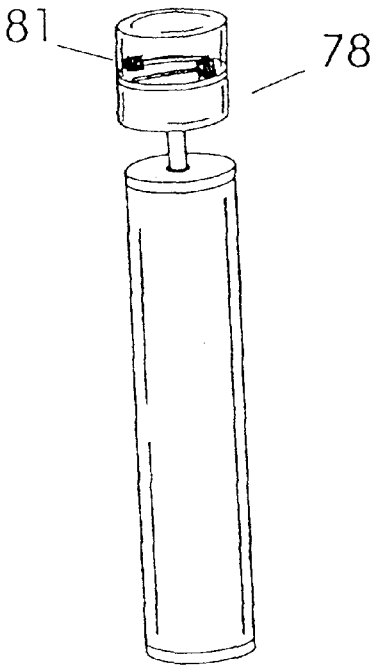

A disk-shaped handle 78 could hold spare needles 81 in place with magnetic attraction, or there could be a removable cap holding the needles in the plunger (as shown in FIG. 38).

Figure 39:
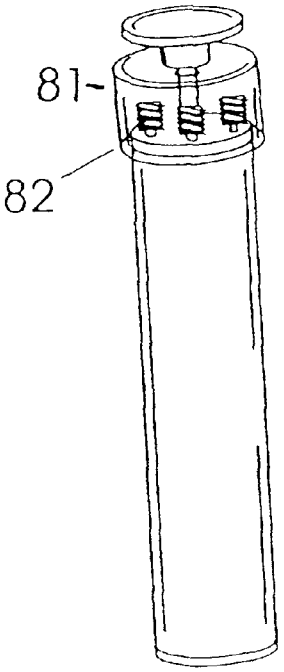
Figure 40:
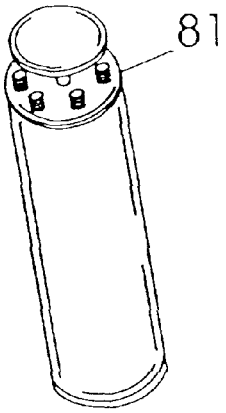

As shown in FIGS. 39 and 40, the spare needles 81 could be placed in the top of the compression cylinder 72 (in which case an optional cover 82 could be used to prevent loss of needles and to keep dirt off of the needle threads).

Figure 41:
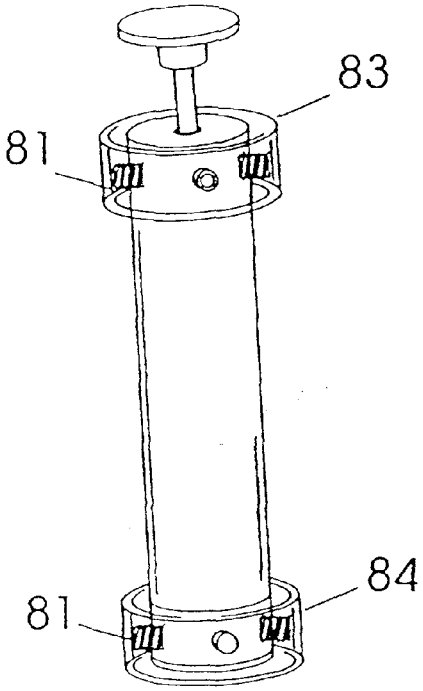

As shown in FIG. 41, the spare needles 81 could be placed in the top and/or the bottom of the compression cylinder 72

(in which case optional covers 83, 84 could be used to prevent loss of needles 81 and to keep dirt off of the needle threads), placed perpendicular or approximately perpendicular to the compression cylinder 72.

Figure 42:
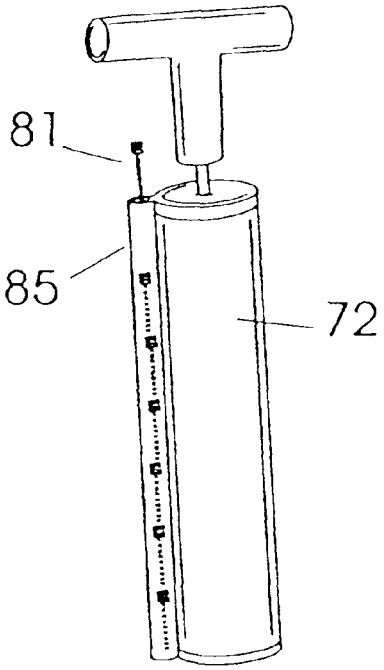
Figure 43:
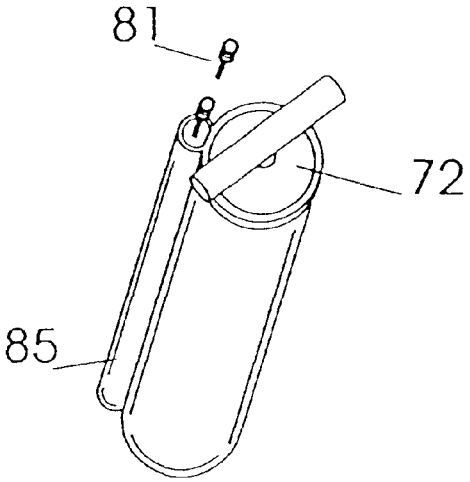

As shown in FIG. 42, the spare needles 81 could be stored in a sleeve 85 attached to the compression cylinder. The sleeve could be extruded or glued or otherwise attached. The sleeve 85 is preferably clear to allow visual inspection of the number of spare needles available. At least one end of the sleeve 85 could have a hinged top, a threaded top, a compression fit, a plug, or some other appropriate cap to keep the needles from falling out of the sleeve.

Figure 44:
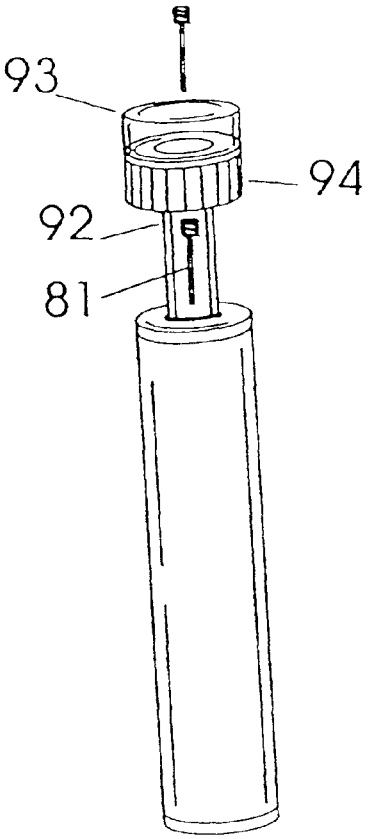
Figure 45:
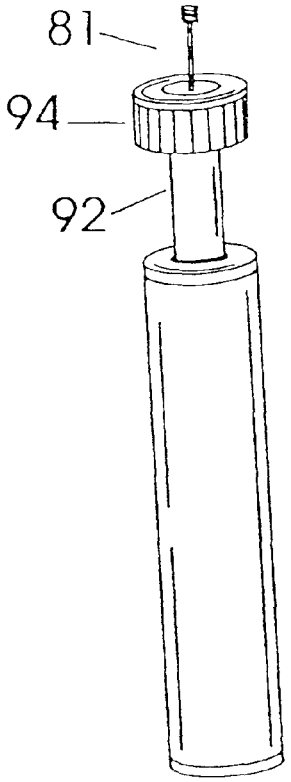

As shown in FIGS. 44 and 45, the spare needles 81 could be stored in a large diameter plunger rod 92 with a hollow center. The handle 94 of the pump could have a cap 93 thereon to close the hollow rod 92. The cap 93 could be hinged, threaded, compression fit, or a plug.

Figure 46:
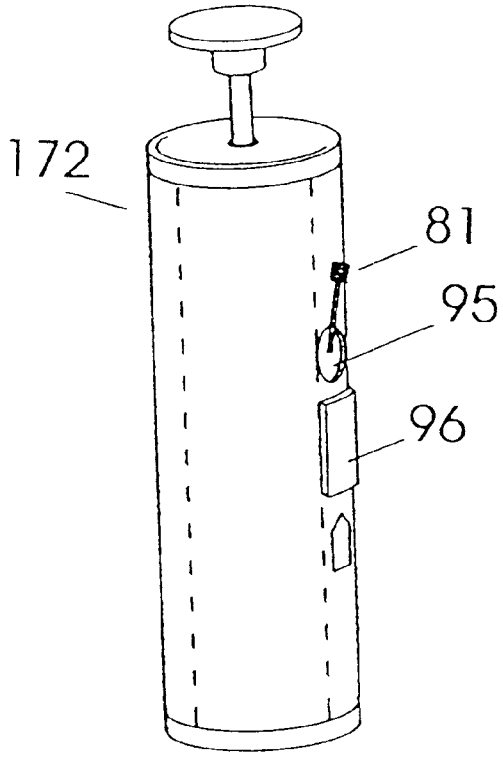

As shown in FIG. 46, the compression cylinder could have a hard, thick wall. Spare needles 81 could be stored in a cavity 95 in the wall of compression cylinder 172. There could be a sliding cap 96 to cover the cavity to keep the needles in. Instead of a sliding cap, any suitable closure or retaining means could be used, such as plugs or magnets.

Figure 47:
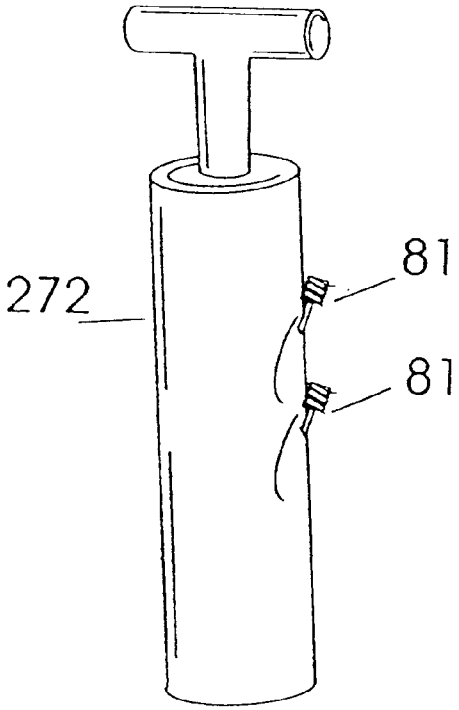

As shown in FIG. 47, the compression cylinder could have a soft, thick wall. Compression cylinder 272 could be totally or partially covered with very soft plastic, cork, or Silly Putty-like material so that needles 81 could be pushed directly into the material.

An alternative pump apparatus, not shown in the drawings, would comprise a standard pump in a container (as a clear container for three tennis balls), with extra needles in the container as well.

Bungee cords are the preferred tensioning means because they serve not only to pull the two frames together, but they also keep the frames apart, making it easier to pick up the first ball with the ball pickup apparatus of the present invention.

As can be seen, the ball retrieving apparatus of the present invention serves to retrieve, store, transport, and inventory sports balls easily and efficiently.

All measurements disclosed herein are at standard temperature and pressure, at sea level on Earth, unless indicated otherwise. All materials used or intended to be used in a human being are biocompatible, unless indicated otherwise.

Fabric-coated elastic cord, such as Bungee cord, can be purchased from Sea Ties in Baton Rouge, La., USA. This cord can be used for the tension means 13, etc.

The foregoing embodiments are presented by way of example only; the scope of the present invention is to be limited only by the following claims.

I claim:

1. A ball retrieving apparatus for storing and retrieving balls of a first diameter from the group consisting of soccer balls, volleyball balls, basketballs, footballs, and rugby balls, comprising:

a pair of parallel, spaced-apart frames sized to hold at least four balls of the first diameter;

tensioning means connecting the two frames, urging the frames together, the tensioning means applying sufficient tension on the frames to normally keep them apart a distance less than the first diameter, but the tensioning means being sufficiently elastic to allow the frames to separate enough to allow a ball to pass between the lower portion of the frames.

2. The apparatus of claim 1, wherein the tensioning means also comprise spacing means for urging the frames apart.

3. Apparatus for picking up, transporting and storing balls of a first diameter from the group consisting of soccer balls, volleyball balls, basketballs, footballs, and rugby balls, comprising:

two opposing frames sized to hold at least four balls of the first diameter;

tension elements separating the two opposing frames;

wherein, when the two opposing frames are forced over a sphere, the tension elements stretch and/or the sphere compresses sufficiently to permit the sphere to enter between the frames, and once the sphere is between the frames it is kept in place by the forces created by the stretched tension elements trying to regain their original unstretched configuration and the pinched sphere trying to regain its original configuration by trying to expand out.

4. The apparatus of claim 3, wherein the tension elements also comprise spacing means for urging the frames apart.

5. The apparatus of claim 3, wherein the frames have a width less than the diameter of a ball to be retrieved therewith.

6. The apparatus of claim 3, wherein the frames are spaced apart less than the diameter of a ball to be retrieved therewith.

7. The apparatus of claim 3, wherein the frames have a width less than twice the diameter of a ball to be retrieved therewith.

8. The apparatus of claim 3, wherein the frames have a length aprroximately equal to four to five times the diameter of a ball to be retrieved therewith.

9. Apparatus for retrieving, transporting, storing, and inventorying sports balls comprising:

(a) first, second, third, fourth, fifth, sixth, seventh and eighth 1¾" by 1¾" PVC elbow connectors for connecting ¾" PVC pipe, each elbow connector having a ¼" diameter hole drilled therein;

(b) a first ¼" diameter, 5½" long, bungee cord connecting the first and fifth elbow connectors;

(c) a second ¼" diameter, 5½" long, bungee cord connecting the second and sixth elbow connectors;

(d) a third ¼" diameter, 5½" long, bungee cord connecting the third and seventh elbow connectors;

(e) a fourth ¼" diameter, 5½" long, bungee cord connecting the fourth and eighth elbow connectors;

(f) a first 4" long PVC pipe connected to the first and second elbow connectors with internal pipe connectors;

(g) a second 4" long PVC pipe connected to the third and fourth elbow connectors with internal pipe connectors;

(h) a third 4" long PVC pipe connected to the fifth and sixth elbow connectors with internal pipe connectors;

(i) a fourth 4" long PVC pipe connected to the seventh and eighth elbow connectors with internal pipe connectors;

(j) a first 32½" long PVC pipe connected to the first and third elbow connectors with internal pipe connectors;

(k) a second 32½" long PVC pipe connected to the second and fourth elbow connectors with internal pipe connectors;

(l) a third 32½" long PVC pipe connected to the fifth and seventh elbow connectors with internal pipe connectors;

(m) a fourth 32½" long PVC pipe connected to the sixth and eighth elbow connectors with internal pipe connectors;

(n) a strap having a first 2' long part and a second 2' long part and connected to the first and second 4" long PVC pipes, the strap having a disconnectible connector to allow the first part of the strap to be separated from the second part of the strap; and (o) a bag riveted to the third and fourth 32½" long PVC pipes, the bag having a zippered opening.

10. The apparatus of claim 9, wherein the apparatus is sized to retrieve balls from the group consisting of soccer balls, volleyball balls, basketballs, footballs, and rugby balls.

* * * * *